US006224329B1

(12) United States Patent
North

(10) Patent No.: US 6,224,329 B1
(45) **Date of Patent: *May 1, 2001**

(54) METHOD OF COOLING A COMBUSTION TURBINE

(75) Inventor: William E. North, Winter Springs, FL (US)

(73) Assignee: Siemens Westinghouse Power Corporation, Orlando, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/226,732

(22) Filed: Jan. 7, 1999

(51) Int. Cl.[7] ..... F04D 31/00
(52) U.S. Cl. ..... 415/116; 415/176; 415/177
(58) Field of Search ..... 415/115, 116, 415/117, 173.1, 173.2, 175, 176, 177, 178; 416/97 R

(56) References Cited

U.S. PATENT DOCUMENTS

| | | | |
|---|---|---|---|
| 3,689,174 | | 9/1972 | Rahaim et al. . |
| 3,864,056 | | 2/1975 | Gabriel et al. . |
| 3,880,435 | | 4/1975 | Thornbald . |
| 4,180,373 | | 12/1979 | Moore et al. . |
| 4,214,851 | | 7/1980 | Tuley et al. . |
| 4,230,436 | * | 10/1980 | Davison ..... 415/1 |
| 4,232,527 | | 11/1980 | Reider . |
| 4,317,646 | | 3/1982 | Steel et al. . |
| 4,526,226 | | 7/1985 | Hsia et al. . |
| 4,551,064 | | 11/1985 | Pask . |
| 5,039,562 | * | 8/1991 | Liang ..... 427/276 |
| 5,081,843 | | 1/1992 | Ishibashi et al. . |
| 5,100,291 | | 3/1992 | Glover . |
| 5,273,396 | | 12/1993 | Albrecht et al. . |
| 5,472,313 | | 12/1995 | Quinones et al. . |
| 5,472,316 | | 12/1995 | Taslim et al. . |
| 5,581,994 | | 12/1996 | Reiss et al. . |
| 5,816,777 | * | 10/1998 | Hall ..... 416/97 R |

FOREIGN PATENT DOCUMENTS

| | | |
|---|---|---|
| 43 26 801 | 2/1995 | (EP) . |
| 0 690 205 | 1/1996 | (EP) . |

* cited by examiner

*Primary Examiner*—Edward K. Look
*Assistant Examiner*—Liam McDowell

(57) ABSTRACT

A method for providing high cooling effectiveness over the entire length of a cooling path (20) by injecting supplemental coolant into the path (20) at one or more selected downstream locations (32,44). Optimal selection of the injection location (32,44) and the ratio of injected flow to main flow will provide a cooling design with superior temperature uniformity and reduced coolant consumption relative to non-supplemented cooling path designs.

10 Claims, 1 Drawing Sheet

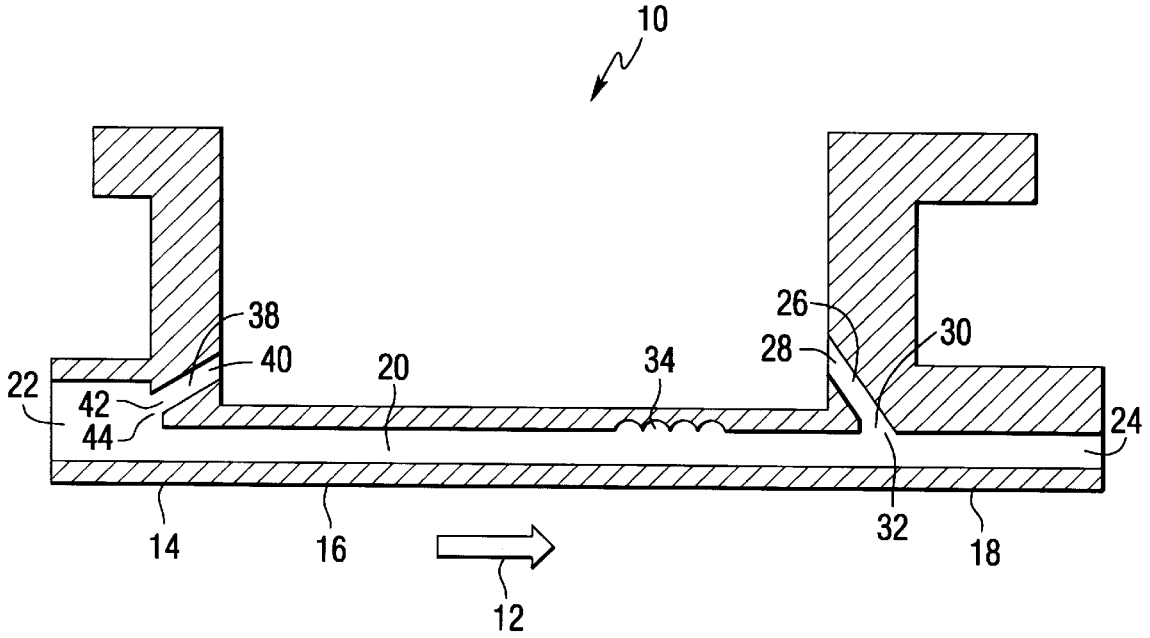
10
38
40
22
42
44
20
34
26
28
30
24
14
16
32
18
12

METHOD OF COOLING A COMBUSTION TURBINE

FIELD OF THE INVENTION

This invention relates generally to the field of cooling of parts that are subjected to a high temperature environment; and more particularly to the cooling of those portions of a combustion or gas turbine that are exposed to hot combustion gases.

BACKGROUND OF THE INVENTION

Modern combustion turbine engines are being designed to operate at increasingly high combustion gas temperatures in order to improve the efficiency of the engines. Combustion temperatures of over 1,000 degrees C. necessitate the use of new superalloy materials, thermal barrier coatings, and improved component cooling techniques. It is known in the art to utilize a portion of the compressed air generated by the compressor as cooling air for convective cooling of selected portions of the turbine. However, the use of compressed air for this purpose decreases the efficiency of the engine, and therefore, designs that minimize the amount of such cooling air are desired. A typical prior art turbine may have a cooling path formed therein for the passage of cooling air from the compressor. However, as the air flows through the cooling path and removes heat energy from the component, the temperature of the cooling fluid rises. As a result, the effectiveness of the cooling air is higher at the inlet end of the cooling path and lower at the outlet end. This temperature gradient can generate additional stress loading within the component. To provide adequate cooling at the outlet end of the cooling flow path it is necessary to provide a flow rate through the flow path which is higher than necessary for the inlet end. As a result, an excessive quantity of cooling fluid is used and the component may be excessively cooled at the inlet end.

U.S. Pat. No. 5,100,291 issued on Mar. 31, 1992 to Glover discloses a cooling technique that addresses this problem. Glover describes a manifold for providing cooling air to a plurality of radial locations in a turbine, and for providing an immediate exit path for the spent cooling air away from the component being cooled. This approach distributes the cooling capacity more evenly throughout the component, but it requires the installation of additional hardware in the turbine to function as the inlet and exit flow paths.

U.S. Pat. No. 5,472,316 issued on Dec. 5, 1995, to Taslim et al discloses the use of turbulator ribs disposed on at least one side wall of a cooling path in order to promote heat transfer efficiency at selected locations along the flow path. The improvement of heat transfer efficiency results from both the turbulence effect and from the acceleration of the cooling fluid flow rate caused by the reduction in the cross sectional area of the flow path. The use of such turbulators will change the rate of temperature rise of a cooling fluid along a cooling flow path. It does not, however, solve the problem of an unacceptable increase in the temperature of the cooling fluid at the outlet end of the cooling path, nor the resulting excess cooling at the inlet end when the flow rate of the cooling fluid is increased to counteract this temperature rise.

Accordingly, it is an object of this invention to provide a method of cooling a portion of a combustion turbine engine that minimizes the amount of cooling air required and that avoids excessive levels of cooling at the inlet end of a cooling path. It is a further object of this invention to provide a method of cooling a portion of a combustion turbine engine that results in a minimum peak level of stress in the component.

SUMMARY

In order to achieve these and other objects of the invention, a method for cooling a portion of a turbine is provided having the steps of: providing a component for the turbine; forming a first cooling path through the component, the first cooling path having an inlet end and an outlet end; forming a second cooling path through the component, the second cooling path having an inlet end and an outlet end, the second cooling path outlet end being fluidly connected to the first cooling path at a junction point disposed between the inlet end and the outlet end of the first cooling path; providing a first cooling fluid to the inlet end of the first cooling path and directing the first cooling fluid along the first cooling path; providing a second cooling fluid at the inlet end of the second cooling path and directing the second cooling fluid along the second cooling path to join the first cooling fluid at the junction point; directing the first and the second cooling fluids to the outlet end of the first cooling path.

A further method according to this invention includes the additional steps of determining a peak design temperature for the surface of the component; and determining the location of the junction point and the flow rates of the first and the second cooling fluids such that no point on the surface exceeds the peak design temperature during the operation of the turbine, and such that the sum of the flow rates of the first and said second cooling fluids is minimized.

BRIEF DESCRIPTION OF THE DRAWINGS

FIG. 1 is a cross sectional view of a blade outer air seal of a combustion turbine that is cooled in accordance with this invention.

DESCRIPTION OF THE PREFERRED EMBODIMENTS

Combustion or gas turbines are known in the art to be assembled from a large number of components, some of which are exposed to the hot combustion air during the operation of the turbine. These components may include, for example, combustor parts, combustor transition pieces, nozzles, stationary airfoils or vanes, and rotating airfoils or blades. FIG. 1 illustrates a cross sectional a view another such component 10, a blade outer air seal, also known as a ring segment. This component 10 is provided in the turbine at a position radially outward from a rotating blade, and it serves to define a portion of the flow path boundary for the hot combustion gas stream 12. Component 10, therefore, has a surface 14 containing a plurality of points 16,18 that are exposed to a harsh high temperature environment during the operation of the turbine.

A first cooling path 20 is formed through component 10. First cooling path 20 has an inlet end 22 and an outlet end 24. First cooling path 20 is preferably formed proximate surface 16 to promote the efficient transfer of heat from surface 16 to a first cooling fluid (not shown) flowing through first cooling path 20. For example, first cooling path 20 may be formed to be 0.06 inches from surface 14. First cooling fluid may be any cooling medium, but is preferably steam or compressed air supplied from the compressor section of the combustion turbine system, as is known in the art.

A second cooling path 26 is also formed through component 10. Second cooling path 26 has an inlet end 28 and an outlet end 30. The second cooling path outlet end 30 is fluidly connected to the first cooling path 20 at a junction 32 located between the inlet end 22 and the outlet end 24 of first cooling path 20.

A third cooling path 38 is also formed through component 10. Third cooling path 38 has an inlet end 40 and an outlet end 42. The third cooling path outlet end 42 is fluidly connected to the first cooling path 20 at a junction 44 located between the inlet end 22 and the outlet end 24 of first cooling path 20. Although not shown as such in FIG. 1, the third cooling path 38 alternatively may be formed to be fluidly connected to second cooling path 26.

A turbulated surface 34 may be provided on at least a portion of the first cooling path 20 as shown, or as not shown, along a portion of the second or third cooling paths 26,38.

The cross sectional flow area of each of the cooling paths 20,26,38 may be consistent throughout their lengths, or may be varied from point to point along the flow path. As illustrated in FIG. 1, flow path 20 is formed with a first cross sectional area at its inlet end and a second, smaller, cross sectional area at its outlet end. The cross section area may be varied to simplify manufacturing of the component 10, or preferably to control the rate of flow of a cooling fluid through the cooling path, thereby affecting the rate of heat transfer from the component to the cooling fluid as is known in the art.

The designer of component 10 may select a method of cooling in accordance this invention that will coordinate the amount of cooling capacity supplied to a given portion of the component with the amount of heat energy that must be removed in order to keep that portion of the component below a predetermined peak design temperature. The designer will be able to achieve this result with a reduced quantity of cooling air when compared to prior art cooling methods.

The selection of the optimum method of cooling for a particular component 10 begins with understanding the physical design of the component, the materials of construction, the temperatures of operation including temperature transients, and the mechanical and thermal stresses within the component. The peak design temperature for the component 10 will primarily be a function of the material of construction. If the temperature of the operating environment of the component exceeds the allowable peak design temperature, a first cooling path 20 may be formed in the component 10, preferably proximate the surface 14 experiencing the maximum temperature. The designer may also determine a peak design temperature for the cooling fluid based on system or thermal efficiency criteria. If the temperature of a first cooling fluid to be directed through the first cooling path 20 is determined to rise above a desirable level, a second cooling path 26 may be formed in the component 10 to inject a cooler fluid into the flow of first cooling fluid. Second cooling path 26 may be formed to be fluidly connected with first cooling path 20 at junction 32. The purpose of directing a second cooling fluid through the second cooling path 26 may be twofold: to cool sections of the component adjacent the second cooling path 26, and also to improve the uniformity of the cooling along the first cooling path 20. The improved uniformity of cooling results from two mechanisms: first, cooling at the inlet end 22 is diminished due to a reduced flow rate being required; and second, the cooling at the outlet end 24 being increased due to the reduced temperature and increase flow rate in those portions of first cooling path 20 that are downstream of junction 32. The cross sectional area of first cooling path 20 may be increased downstream of junction 32 to accommodate the additional volume resulting from the joining of the first cooling fluid and the second cooling fluid at the junction 32, or to otherwise affect the heat transfer rate between the component 10 and the cooling fluids. The location of the junction 32 may be selected to ensure that no point 16,18 on the surface 14 of component 10 exceeds the peak design temperature during operation of the component 10. Similarly, by selecting an appropriate location for the junction 32 the peak temperature of the cooling fluids may be maintained below a maximum design temperature without excess cooling of those portions of component 10 located near inlet end 22. By avoiding excess cooling of any portion of component 10, the sum of the flow rates of the first and the second cooling fluids may be minimized.

In order to optimize the cooling of component 10, the designer may calculate the optimum relative rates of flow required for the first, second, and third cooling fluids. For example, if the section of component 10 cooled by the second cooling path 26 is highly stressed or has a relatively high heat load, it may be desirable to direct a relatively higher rate of flow of second cooling fluid to second cooling path 26. Conversely, if the surrounding area is subjected to a relatively low heat load, or is partially cooled by other sources of heat energy removal, it may be desirable to direct a relatively lower rate of flow of third cooling fluid to third cooling path 38.

The method of cooling component 10 may include providing a turbulated surface on any portion of the cooling paths 20,26,38. Such turbulated surfaces may serve to increase the heat transfer where needed, for example in the first cooling path 20 just upstream of junction 32, since in this area the temperature of the first cooling fluid will be at a maximum value.

The method of this application provides a means for maintaining high cooling effectiveness over the entire length of a long cooling flow path. This is achieved by injecting supplemental coolant into the cooling flow path at one or more selected down steam locations. Optimal selection of injection location, the ratio of injected flow to main flow, the cross sectional area of the flow path, and the use of turbulators or other surface enhancement within the flow path, will provide a cooling design with superior temperature uniformity and reduced coolant consumption relative to non-supplemented cooling path designs.

Other aspects, objects and advantages of this invention may be obtained by studying the Figures, the disclosure, and the appended claims.

What is claimed is:

1. A method of cooling a turbine comprising the steps of:

providing a component for said turbine;

forming a first cooling path through said component below a surface to be cooled, said first cooling path having an inlet end and an outlet end disposed remote from said surface, said first cooling path including a cooling length disposed below said surface;

forming a second cooling path through said component below said surface, said second cooling path having an inlet end and an outlet end disposed remote from said surface, said second cooling path outlet end being fluidly connected to said first cooling path at a junction located between the inlet end and the outlet end of said first cooling path along said cooling length;

providing a first cooling fluid to the inlet end of said first cooling path and directing said first cooling fluid along said first cooling path;

providing a second cooling fluid at the inlet end of said second cooling path and directing said second cooling fluid along said second cooling path to join said first cooling fluid at said junction point;

directing said first and said second cooling fluids to the outlet end of said first cooling path.

2. The method of claim 1, wherein said junction comprises a first junction, and further comprising the steps of:

forming a third cooling path through said component below said surface, said third cooling path having an inlet end and an outlet end disposed remote from said surface, said third cooling path outlet end being fluidly connected to said first cooling path at a second junction disposed between the inlet end and the outlet end of said first cooling path along said cooling length; and providing a third cooling fluid at the inlet of said third cooling path and directing said third cooling fluid along said third cooling path to join said first cooling fluid at said second junction.

3. The method of claim 1, further comprising the step of providing a turbulated surface in at least a portion of at least one of said first and said second cooling paths.

4. The method of claim 1, further comprising the step of selecting the location of said junction point to minimize the peak temperature of said first and said second cooling fluids.

5. The method of claim 1, further comprising the steps of:

determining a peak design temperature for said first and said second cooling fluids; and calculating the relative rates of flow required for said first and said second fluids such that the peak design temperature is not exceeded in either said first or said second cooling fluid and such that the sum of said first and said second cooling fluid flow rates is minimized.

6. The method of claim 1, wherein said component has a surface that is exposed to a high temperature environment during the operation of said turbine; and further comprising the steps of:

determining a peak design temperature for said surface;

determining the location of said junction point and the flow rates of said first and said second cooling fluids such that no point on said surface exceeds said peak design temperature during the operation of said turbine, and such that the sum of the flow rates of said first and said second cooling fluids is minimized.

7. The method of claim 1, wherein the step of forming a first cooling path further comprises the step of forming a first cross-sectional area in a first portion of said first cooling path and a second cross-sectional area in a second portion of said first cooling path.

8. The method of claim 1, wherein said component comprises a first point and a second point on its surface, and further comprising the step of determining the location of said junction point and the rate of flow of said first and said second cooling fluids such that each of said first point and said second point do not exceed a predetermined peak temperature during the operation of said turbine.

9. A method of cooling a ring segment of a combustion turbine comprising the steps of:

forming a first cooling path through said ring segment below a surface to be cooled, said first cooling path having an inlet end and an outlet end disposed remote from said surface;

forming a second cooling path through said ring segment below said surface, said second cooling path having an inlet end and an outlet end disposed remote from said surface and including a cooling length disposed below said surface, said second cooling path outlet end being fluidly connected to said first cooling path at a junction located between the inlet end and the outlet end of said first cooling path along said cooling length;

supplying first cooling fluid to the inlet end of said first cooling path and directing said first cooling fluid along said first cooling path;

providing second cooling fluid at the inlet end of said second cooling path and directing said second cooling fluid along said second cooling path to join said first cooling fluid at said junction point; and directing said first and said second cooling fluids to the outlet end of said first cooling path.

10. A method of cooling a ring segment of a combustion turbine, the ring segment having a first portion that is highly stressed and further having a surface exposed to hot combustion air during operation of the turbine, the method comprising the steps of:

forming a first cooling passage through the ring segment below the surface exposed to hot combustion air, the first cooling passage having an inlet end and an outlet end including a cooling length disposed below the surface;

forming a second cooling passage through the first portion, the second cooling passage having an inlet end and an outlet end, the second cooling path outlet end being fluidly connected to the first cooling passage at a junction located between the inlet end and the outlet end of the first cooling passage along the cooling length;

providing a first cooling fluid to the inlet end of the first cooling passage and directing the first cooling fluid the cooling length;

providing a second cooling fluid to the inlet end of the second cooling passage and directing the second cooling fluid along the second cooling passage to join the first cooling fluid at the junction; and directing the combined flow of the first cooling fluid and the second cooling fluid to the outlet end of the first cooling passage.

* * * * *